US006062384A

United States Patent [19]

Ueno et al.

[11] Patent Number: 6,062,384

[45] Date of Patent: May 16, 2000

[54] FASTENER STRUCTURE

[75] Inventors: Hideyuki Ueno, Kanagawa; Akira Furutsu, Lion's Station Plaza, 704, 20-12, Ryogoku 2-chome, Sumida-ku, Tokyo, both of Japan

[73] Assignees: Kotec's Company, Ltd.; Akira Furutsu, both of Tokyo, Japan

[21] Appl. No.: 09/187,260

[22] Filed: Nov. 6, 1998

[30] Foreign Application Priority Data

Nov. 10, 1997 [JP] Japan ..... 9-306758

[51] Int. Cl.[7] ..... B65D 85/24

[52] U.S. Cl. ..... 206/346; 206/820; 24/711.1

[58] Field of Search ..... 206/346, 338, 206/820, 343–345, 347, 348; 24/711.1, 711.5, 16 PB; 227/67, 71; 40/662

[56] References Cited

U.S. PATENT DOCUMENTS

| | | | |
|---|---|---|---|
| Re. 32,332 | 1/1987 | Kato | 206/346 |
| 3,586,609 | 6/1971 | Won | 206/343 |
| 4,456,123 | 6/1984 | Russell | 206/343 |
| 4,712,677 | 12/1987 | Russell | 206/345 |
| 5,110,638 | 5/1992 | Vogdes | 428/35.1 |
| 5,593,033 | 1/1997 | Kunreuther | 206/346 |

*Primary Examiner*—Paul T. Sewell
*Assistant Examiner*—Nhan T. Lam
*Attorney, Agent, or Firm*—Greer, Burns & Crain, Ltd.

[57] ABSTRACT

A fastener structure is formed as a collection of a number of fasteners, each fastener having a head, a filament that is connected to the head, and a crossbar, each fastener being connected to a connected to a common linear support element, via a linking section that is an extension that crosses over the above-noted crossbar in the axial direction of the filament, so that the head parts and the crossbars of each of the fasteners are mutually parallel, wherein the force that is required to bend the above-noted common linear support element along a plane formed by a group of filaments is smaller than the force that is required to bend that bends the fastener structure in another direction.

8 Claims, 6 Drawing Sheets

FASTENER STRUCTURE

BACKGROUND OF THE INVENTION

1. Field of the Invention

The present invention relates to a fastener structure, and mo re particularly to a fastener that is used for the purpose of affixing various types of labels (such as including tags indicating brand names, material, method of handling and/or price) to objects such as clothing, sundry items, footwear, socks and bags, clothes hangers, display shelves, and product display apparatuses, and to a fastener that is used to bundle together a number of items of clothing or sundry items as one group of products, and to a fastener structure for supplying the above-noted fastener.

2. Background of the Invention

In the past, one means of attaching a label or tag to a product or for bundling a number of products together was the fastener 10 as shown in FIG. 8.

The fastener 10, as shown in FIG. 8, comprises a head part 3, a filament 2 that is connected to the head part 3, and a crossbar 1, which is provided on th e end of the filament 2 opposite from the end that is connected to the head part 3, and which is approximately perpendicular to the filament 2.

As This fastener 10, for example as shown in FIG. 5, a plurality of fasteners 10 may be formed on a structure 11 so that they are linked and mutually parallel to one another, after which, for example as shown in FIG. 6, a special fastener attaching apparatus 30, that is, a gun is used to poke and pass the individual fasteners 10 as they are cut away from the above-noted fastener structure 11, thereby attaching them to a prescribed product or object.

More specifically, as shown in FIG. 7, a fastener structure 11 that is provided at the upper surface of the above-noted fastener attaching apparatus 30 is inserted through a supply aperture 32 of a supply part 31 thereof, so that, as shown for example in FIG. 6, a trigger part 16 can be operated, the result being that individual fasteners 10 that are separated away from the fastener structure 11 are inserted into a hollow needle 12, after which they are ejected from an end of the hollow needle that protrudes from the opposite side of a product or object, thereby attaching the fastener 10 to the product or object.

During this process, the filament 2 of the fastener 10 is guided into the product or object via a slit 33 that is provided in the fastener attaching apparatus 30 and a slit 15 that is provide at the side of the hollow needle 12.

In using the above-noted fastener structure 11 and fastener attaching apparatus 30 in the past to attach a fastener 10 to an individual product or object, because of the small number of fasteners 10 which make up the fastener structure 11 and the length of the fastener structure, which was not that great, when performing the operation of attaching the above-noted fastener 10, the operation is performed with the fastener structure 11, as shown by P1 in FIG. 6, standing upright from the upper supply aperture 31 of the fastener attaching apparatus 30, in an approximate perpendicular attitude thereto.

However, to achieve the object of improving the efficiency of the abovedescribed operation, recent years have seen an increase in the number of fasteners 10 that make up the fastener structure 11, which has resulted in a fastener structure 11 of great length.

If the above-noted operation is performed under the above-noted conditions, and if the fastener structure 11 is mounted at the upper supply aperture 31 of the fastener attaching apparatus 30, the operation will be performed with a long section of the fastener structure 11 upright in an approximately perpendicular attitude with respect to the fastener attaching apparatus 30 at the upper supply aperture 31 thereof. The result being that the fastener structure 11 not only flops around, making the above-noted operation difficult, but also in many cases can come into contact with other products or objects, can come into contact with the operator's hand or fingers, and can cause damage to products and injury to the operator, thereby not only lowering product quality, but also reducing the working efficiency if attempts are made in order to prevent such risks as noted above.

For the above-noted reasons, as shown in FIG. 6, a method has been developed to limit the long protrusion of the fastener structure 30 from the top of the fastener attaching apparatus, to provide a stable supply of the fastener structure 11, and to improve work efficiency and to prevent work accidents. This method being one of providing a limiting guide 22 for the fastener structure 11 in the region of the fastener structure supply aperture 31 of the fastener attaching apparatus 30. This limiting guide 22 acts to deform the shape of the feed path of the fastener structure 11, for example so as to curve as indicated by P2 in FIG. 6.

In the past, however, because the fastener structure 11 was designed with the understanding that it would protrude approximately perpendicularly from the fastener attaching apparatus 30, that is, in the direction indicated as P1 in FIG. 6, it was formed so as to be rigid, making it difficult to bend it in the curve indicated as P2 in FIG. 6.

Therefore, if a fastener structure 11 of the past were to be forcibly bent to a curved shape such as indicated as P2 in FIG. 6, because of the excessive load that would be placed on the configuration of the fastener structure, there was the problem of damaging the fastener attaching apparatus 30.

For the above-noted reason, in the past it was only practical to use a short fastener structure 11 or, stated differently, to use a fastener structure 11 that does not have many fasteners 10, which results in reduced efficiency and in increased costs.

Accordingly, it is an object of the present invention to provide a fastener structure that overcomes the above-noted drawbacks of the prior art, and one which, even if the length of the fastener structure 11 becomes great, it is possible to use a fastener attaching apparatus of the past to achieve highly safe attachment of the fasteners.

In order to achieve the above-noted object, the present invention has the following basic technical constitution. Specifically, the present invention is a structure that is a collection of a plurality of fasteners, each of which comprises a head part, a filament that is connected to the head part, and a crossbar that is provided on the end of the filament opposite from the end that is connected to the head part, and which is approximately perpendicular to the filament. Each of the fasteners is connected to a common linear support element, via a linking section that is an extension that crosses over the above-noted crossbar in the axial direction of the filament, so that the head parts and the crossbars of each of the fasteners are mutually parallel, a force that bends the above-noted common linear support element along a plane formed by a group of filaments is smaller than a force that bends the fastener structure in another direction.

And more specifically, the fastener structure of the present invention is provided with a plurality of apertures intermittently in the longitudinal direction of the common linear support element.

By adopting the above-described technical constitution, a fastener structure according to the present invention can easily be bent in a direction of the arrangement of the fasteners and, as a result, can be easily manufactured in a long configuration suitable for, and capable of being used with, a specific limiting guide 22, such as that shown in FIG. 6.

DESCRIPTION OF THE PREFERRED EMBODIMENTS

Preferred embodiments of the present invention will be described in detail below, with reference being made to relevant accompanying drawings.

Figure 1:
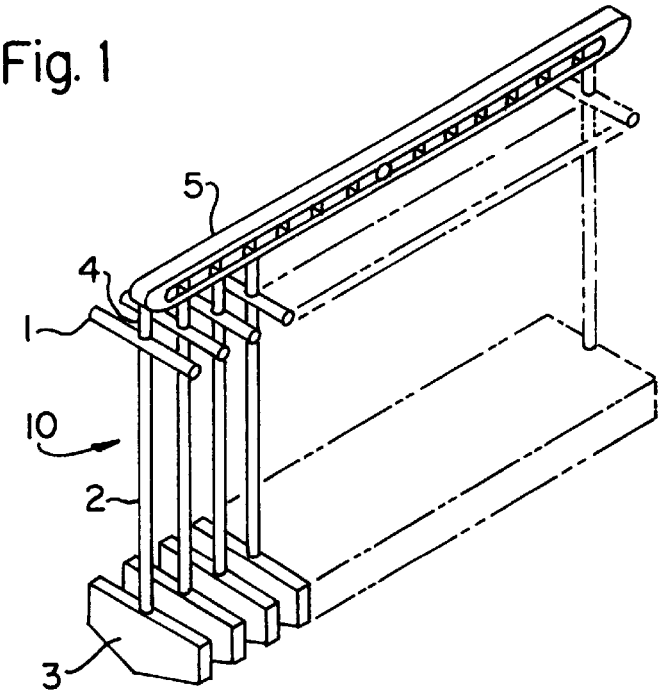
FIG. 1 is a perspective view that shows the configuration of a specific example of fastener structure according to the present invention.

Specifically, referring to FIG. 1, which is a perspective view of an example of a fastener structure 10 according to the present invention, this drawing shows a structure 11 that is formed as a collection of a plurality of fasteners 10. The fastener 10 includes comprising a head part 3, a filament 2 that is connected to the head part 3, and a crossbar 1 that is provided on the end of the filament 2 that is opposite the end thereof which is connected to the head 3 and which is approximately perpendicular to the filament 2. Each of these structures 10 is connected to a common linear support element 5, via a linking section 4 that is an extension that crosses over the above-noted crossbar 1 in the axial direction of the filament, so that the head parts 3 and the crossbars 1 of each of the fasteners 10 are mutually parallel. The connection between the linear support element J and the structures 10 is configured such that a force that bends the above-noted common linear support element 5 along a plane S (see FIG. 8)formed by a group of filaments 2 can be smaller than a force that bends the fastener structure 11 in another direction.

Figure 5:
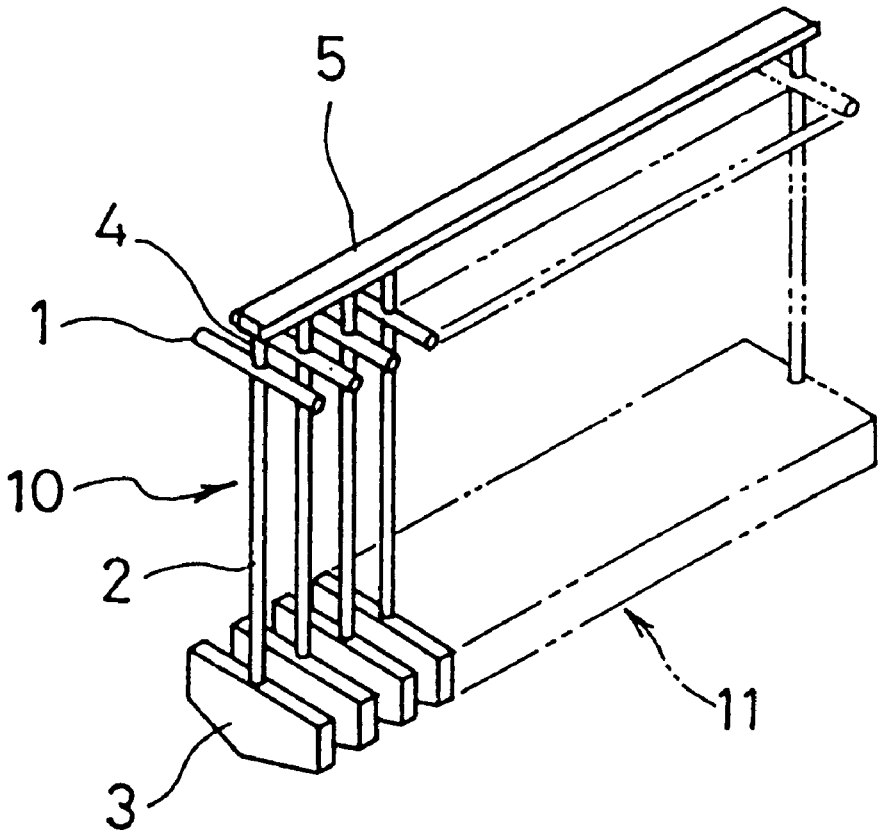
Fig. 5 (PRIOR ART)
FIG. 5 is a drawing that shows an specific example of the configuration of a fastener structure of the past.
Figure 6:
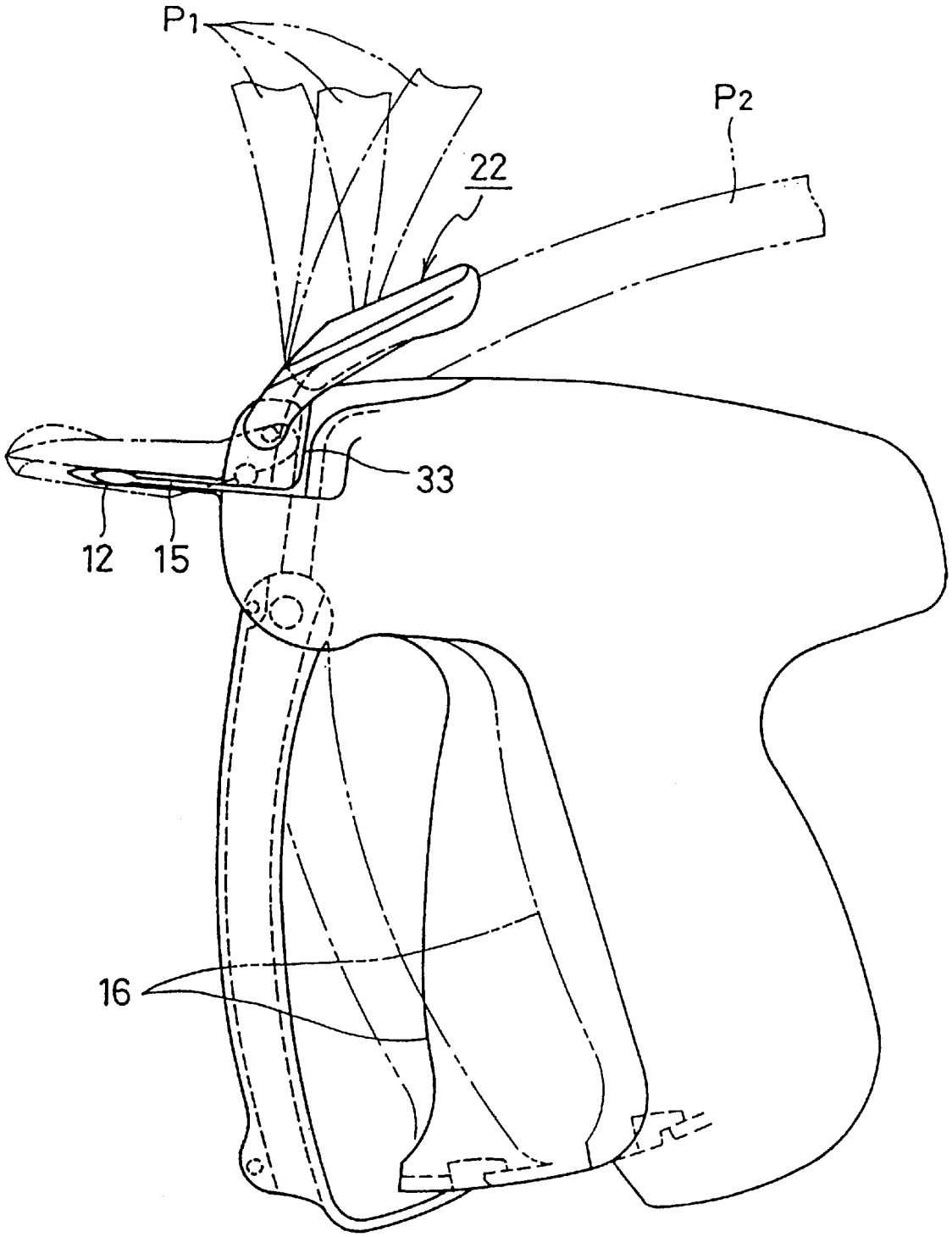
Fig.6 (PRIOR ART)
FIG. 6 is a plan view that shows the configuration of a specific example of a fastener attaching apparatus of the past.
Figure 7:
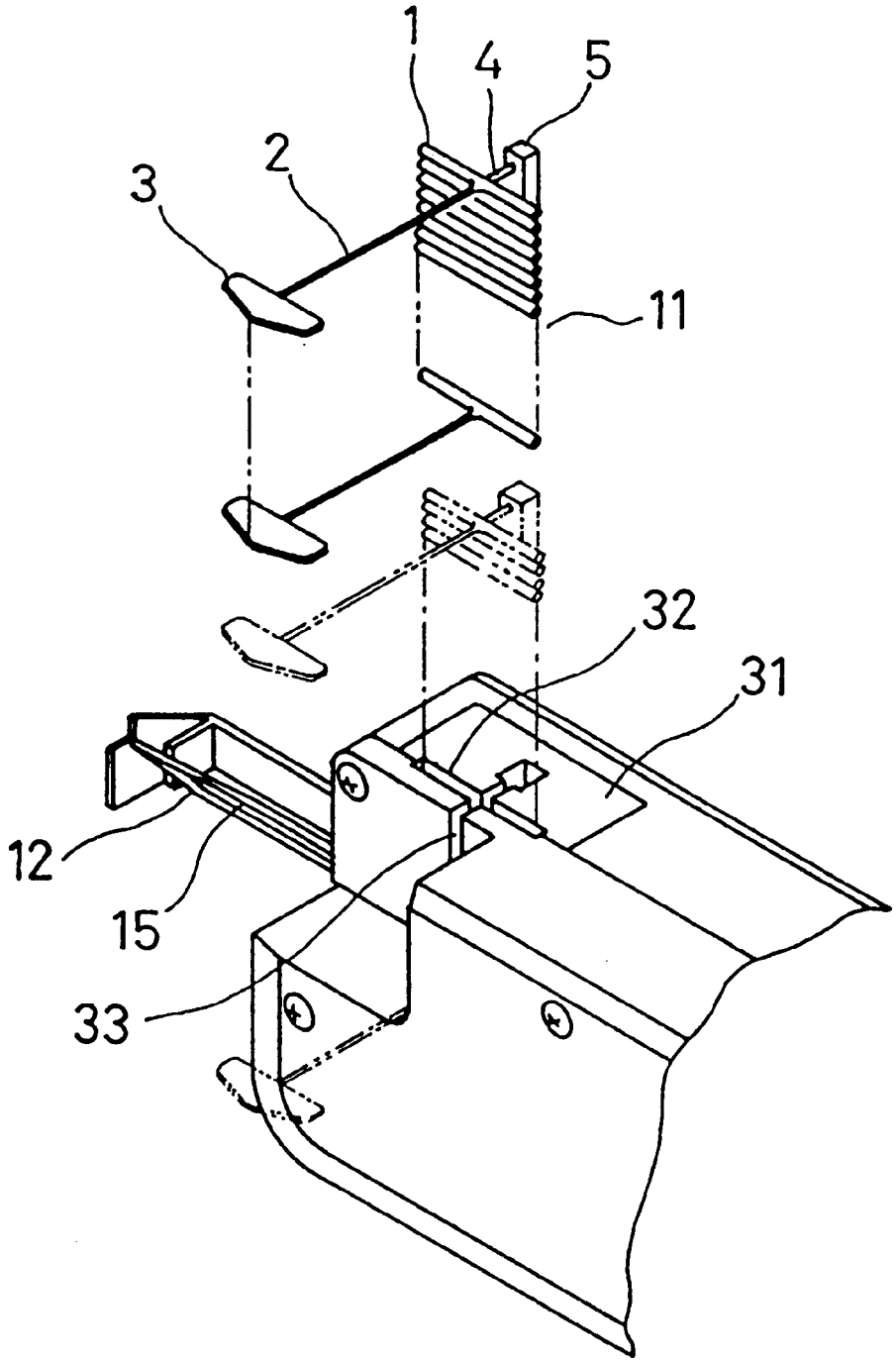
Fig. 7 (PRIOR ART)
FIG. 7 is a plan view that shows a specific example of the structure of the fastener supply part of a fastener attaching apparatus of the past.
Figure 8:
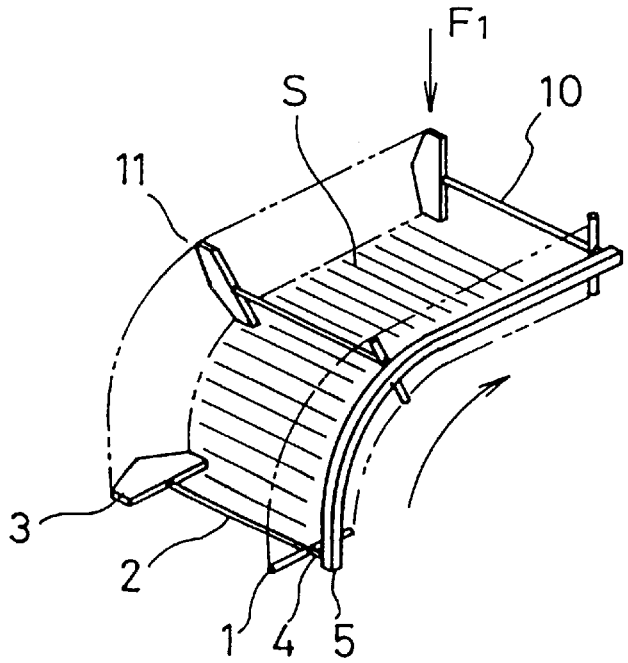
FIG. 8 is a perspective view that illustrates an example of the case of bending a fastener structure according to the present invention into a curve.

That is, in contrast to a fastener structure 11 of the past, wherein the common linear support element 5, as shown in FIG. 5, was formed so as to be quite thick, resulting in that it was impossible to bend the common linear support element 5 along the plane S formed by a large number of filaments, in the case of the fastener structure 11 according to the present invention, as shown in FIG. 8, it is possible to easily bend the common linear support element 5 along the plane S that is formed by a group of filaments 2.

That is, as shown in FIG. 8, if one end of the fastener structure 11 is fixed to a holding part so that the filaments are parallel, and an appropriate force F1 is applied to the other end of the fastener structure 11 perpendicularly to this plane S, it is possible to easily bend the common linear support element 5 as shown in FIG. 8.

Figure 9:
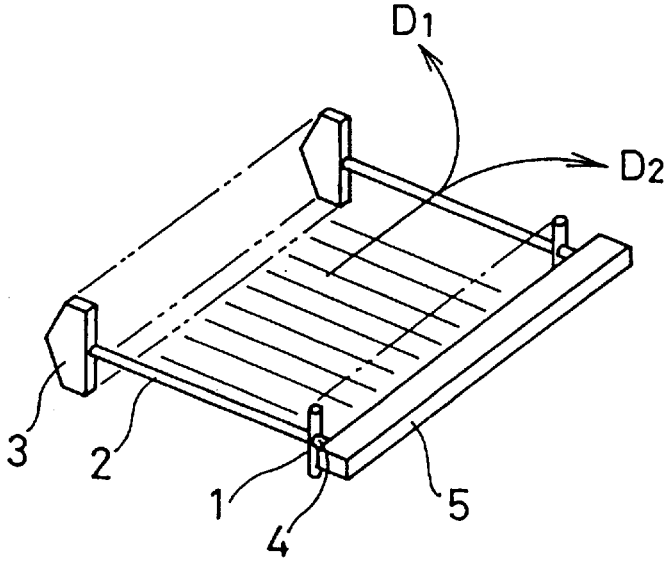
FIG. 9 is a perspective view that shows the direction in which it is difficult to bend the fastener structure according to the present invention.

For this reason, it is desirable that, in a fastener structure 11 according to the present invention, the common linear support element 5 be configured so as to enable it to be easily bent in the direction indicated above but so that, in other directions, such as the direction D1 or the direction D2 that are indicated in FIG. 9, it is difficult to bend.

Specifically, it is desirable that the common linear support element 5 in a fastener structure 11 according to the present invention have a cross-section which has a length in the direction that coincides with the axial direction of the filament 2 that is greater than the length in the direction that is perpendicular to the filament, that is, the direction that of the crossbar 1.

Figure 2:
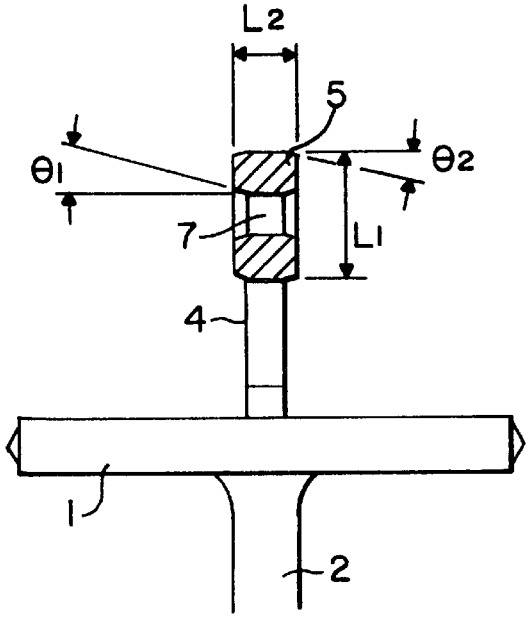
FIG. 2 is a side view that shows an example of the configuration of a common linear support element of a fastener structure according to the present invention.

That is, the cross-section of the common linear support element 5 is configured so that length L1 as shown in FIG. 2, which coincides with the axial direction of the filament 2, is greater than the length L2, which coincides with the direction of the crossbar 1.

The present invention does not impose any particular restriction with regard to the shape of the head 3 and, while a shape having some degree of surface area such as shown in FIG. 1 is preferable, it is also possible to have a head that has a shape similar to that of the crossbar 1.

Figure 3:
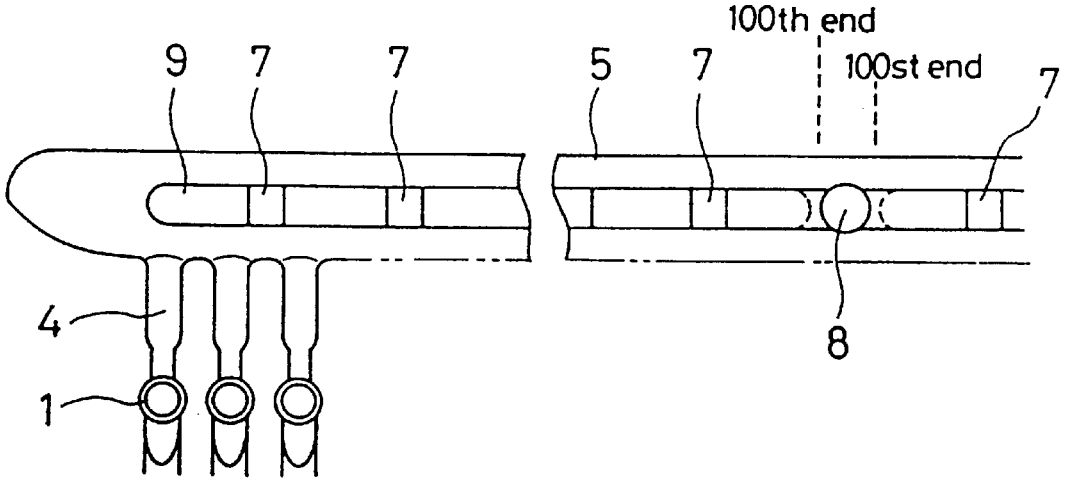
FIG. 3 is a cross-sectional view that shows an example of the configuration of a common linear support element of a fastener structure according to the present invention.
Figure 4:
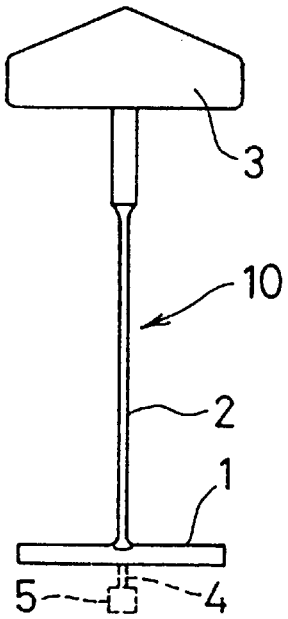
Fig. 4 (PRIOR ART)
FIG. 4 is a drawing that shows a specific example of the configuration of a fastener of the past.

It is desirable that the common linear support element 5 of the present invention, as shown in FIG. 3, be provided with apertures 7, these being provided intermittently along the longitudinal direction thereof.

This configuration not only makes the common linear support element 5 more flexible, but also contributes to a reduction in weight, a reduction in raw materials used, and a reduction in cost.

There are no particular restrictions placed on the aperture surface of the aperture 7, the number of these apertures, and the interval of the apertures, these being establishable as appropriate.

Additionally, in a fastener structure 11 according to the present invention, it is also desirable that the common linear support element 5 have at least on one side thereof a groove 9 along the longitudinal direction thereof.

This configuration, in addition to imparting flexibility to the common linear support element 5, also contributes to a reduction in weight, a reduction in raw materials used, and a reduction in cost, and also makes it possible to maintain the strength required to resist bending in the direction shown in FIG. 9.

Furthermore, in the present invention, it is possible for some apertures, such as aperture 8 of the above-noted plurality of apertures 7, to be of a different shape than the apertures 7.

There is no particular specification of a condition for mixing apertures having a different shape at a prescribed interval with respect to the other apertures.

That is, the shape of the aperture 8, the size thereof, and the arrangement ratio thereof with respect to the other apertures 7 can be arbitrarily established.

For example, as shown in FIG. 3, it is possible after a prescribed number of continuous apertures 7 of a rectangular shape, to have one round aperture 8, after which there is a prescribed number of rectangular apertures 7, in which case the position of the aperture 8 can be established in accordance with the number of fasteners 10.

That is, by inserting an aperture 8 for every 100 apertures 7, if one fastener structure 11 includes 300 fasteners 10, if a user uses the fasteners 10 in units of 100, this can be used as a guide in dividing up the fastener structure 11 into these units.

It is desirable that the fastener structure 11 according to the present invention be formed as one piece from a synthetic resin material such as nylon or polypropylene.

By virtue of the above-noted technical constitution, the fastener structure according to the present invention, even in the case in which this structure is long, can be used with a fastener attaching apparatus 30 as used in the past to perform highly safe attachment.

What is claimed is:

1. A structure comprising a collection of a plurality of fasteners, each said fastener including a head part, a filament that is connected to said head part, and a crossbar that is provided on a first end of said filament that is opposite from a second end that is connected to said head, and that is approximately perpendicular to said filament, wherein each of said fasteners is connected to a common linear support element via a linking section that is an extension of said filament that crosses over said crossbar so that said head parts and said crossbars of each of said fasteners are mutually parallel, said structure being configured and arranged such that a force required to bend said common linear support element along a plane formed by a group of said filaments is smaller than a force required to bend said fastener structure in other directions, and wherein said common linear support element further includes therein a plurality of apertures located intermittently in the longitudinal direction thereof.

2. The fastener structure according to claim 1, wherein said common linear support element includes a groove extending along the longitudinal direction thereof.

3. The fastener structure according to claim 2, wherein at least some of said plurality of apertures are located within said groove.

4. The fastener structure according to claim 1, wherein at least one of said plurality of apertures has a shape that differs from the shape of at least one other aperture.

5. The fastener structure according to any one of claims 1 to 4, wherein said common linear support element has a cross-section having a length in a direction that coincides with the axial direction of said filament that is greater than a length that is perpendicular to said filament.

6. The fastener structure according to claim 5, wherein said fastener structure is fabricated as a single unit from a synthetic resin material.

7. The fastener structure according to claim 1, wherein at least one of said plurality of apertures differs form at least one of the other apertures.

8. The fastener structure according to claim 1, wherein said plurality of apertures include apertures of a first type and apertures of a second type, which are different from said apertures of said first type, and further wherein said apertures of said second type are located periodically along a line of said apertures of said first type, such that apertures of said first type are divided into a plurality of sets where each set includes the same number of apertures of said first type.

* * * * *